US006871856B1

(12) United States Patent
Rozboril

(10) Patent No.: US 6,871,856 B1
(45) Date of Patent: Mar. 29, 2005

(54) METHOD FOR PLAYING A CASINO CARD GAME

(76) Inventor: John Rozboril, 2725 S. Nellis Blvd., Las Vegas, NV (US) 89121

( * ) Notice: Subject to any disclaimer, the term of this patent is extended or adjusted under 35 U.S.C. 154(b) by 0 days.

(21) Appl. No.: 10/229,185

(22) Filed: Aug. 26, 2002

Related U.S. Application Data

(63) Continuation-in-part of application No. 09/879,731, filed on Jun. 14, 2001, now abandoned.

(51) Int. Cl.[7] ..... A63F 1/00
(52) U.S. Cl. ..... 273/292; 463/13
(58) Field of Search ..... 273/292, 277; 463/11–13

(56) References Cited

U.S. PATENT DOCUMENTS 5,098,107 A * 3/1992 Boylan et al. ..... 273/292
5,636,843 A * 6/1997 Roberts ..... 273/292
5,685,774 A * 11/1997 Webb ..... 463/13
5,799,945 A * 9/1998 Boylan et al. ..... 273/292
5,816,575 A * 10/1998 Keller ..... 273/292
5,839,730 A * 11/1998 Pike ..... 273/292
5,901,958 A * 5/1999 Andrews ..... 273/292
6,334,613 B1 * 1/2002 Yoseloff ..... 273/292
6,345,823 B1 * 2/2002 Webb ..... 273/292
6,752,394 B2 * 6/2004 Malcolm ..... 273/292

* cited by examiner

*Primary Examiner*—Vishu Mendiratta
(74) *Attorney, Agent, or Firm*—Robert Ryan Morishita; Anderson & Morishita, LLC

(57) ABSTRACT

A method for playing a Poker-style card game where the player makes a first bet and is dealt three cards. Based upon the three cards the player has the option of placing a second bet. A fourth card is dealt to the player and the player's four card hand is compared to a predetermined schedule of winning four card hands of flushes and same color outcomes. Winning hands are paid and the player loses for non-winning hands. For players making second bets, a fifth card is dealt and the player's five card hand is compared to a dealer's five card hand. The player's hand must outrank the dealers for the player to win and be paid according to a predetermined schedule of winning outcomes.

9 Claims, 2 Drawing Sheets

METHOD FOR PLAYING A CASINO CARD GAME

CROSS-REFERENCE TO RELATED APPLICATION

The present application is a Continuation-in-Part application of commonly owned application Ser. No. 09/879,731 filed Jun. 14, 2001 and now abandoned.

FIELD OF THE INVENTION

The present application relates to methods for playing a Poker-like, casino card game.

BACKGROUND

There are many forms of Poker-type game methods such as CARRIBEAN STUD® which is as described in U.S. Pat. No. 4,836,553 issued Jun. 6, 1989 to Suttle et al., the disclosure of which is hereby incorporated by reference, and LET IT RIDE® which is described in Breeding U.S. Pat. No. 5,288,081 issued Feb. 22, 1994, the disclosure of which is hereby incorporated by reference. These games are five card games and have different betting strategies.

There is another game, a variation of Poker, called Three Card Poker described in Webb, U.S. Pat. No. 6,345,823 the disclosure of which is hereby incorporated by reference. In this game a player places two wagers, an ante wager and a pairs plus wager at the beginning of the round and is dealt three cards, as is the dealer. If the player decides to continue he places a third, "Play" wager and if not the player forfeits their Ante and pairs plus wager. The dealer then reveals his hand and each of the player's hands (in sequence) to resolve the wagers. The players win the Ante and Play wagers automatically if the dealer does not have a qualifying holding, e.g. Queen high or better, and are paid even money. If the dealer does have a qualifying holding and the player's hand outranks the dealer's (based upon a Poker related ranking of hands), the player is paid even money of the Ante and Play wagers. Conversely, if the dealer does have a qualifying holding and the dealer's hand outranks the player's hand, the player loses the Ante and Play wagers. If the player and dealer have a tie ranking, the hand is a push. In another version, if the player has a certain outcome they may be paid at enhanced odds on the pairs plus wager. That is, this wager is against a predetermined pay schedule requiring a player to have a pair or greater to win. If they do not have a pair, they lose the pairs plus wager.

A drawback to the three card Poker game described above is that the player must risk two, mandatory, wagers, ante and pairs plus wager, in advance of seeing his three card hand. Further this game requires the dealer to qualify.

There is a need for a new game method which does not suffer from the drawbacks noted above, which provides for a player to exercise a degree of strategy, which does not mandate a plurality of wagers and which provides for multiple and serial winning hands.

BRIEF DESCRIPTION OF THE DRAWINGS

These and other features and advantages will become appreciated as the same becomes better understood with reference to the description, claims and drawings wherein:

DESCRIPTION

Figure 1:
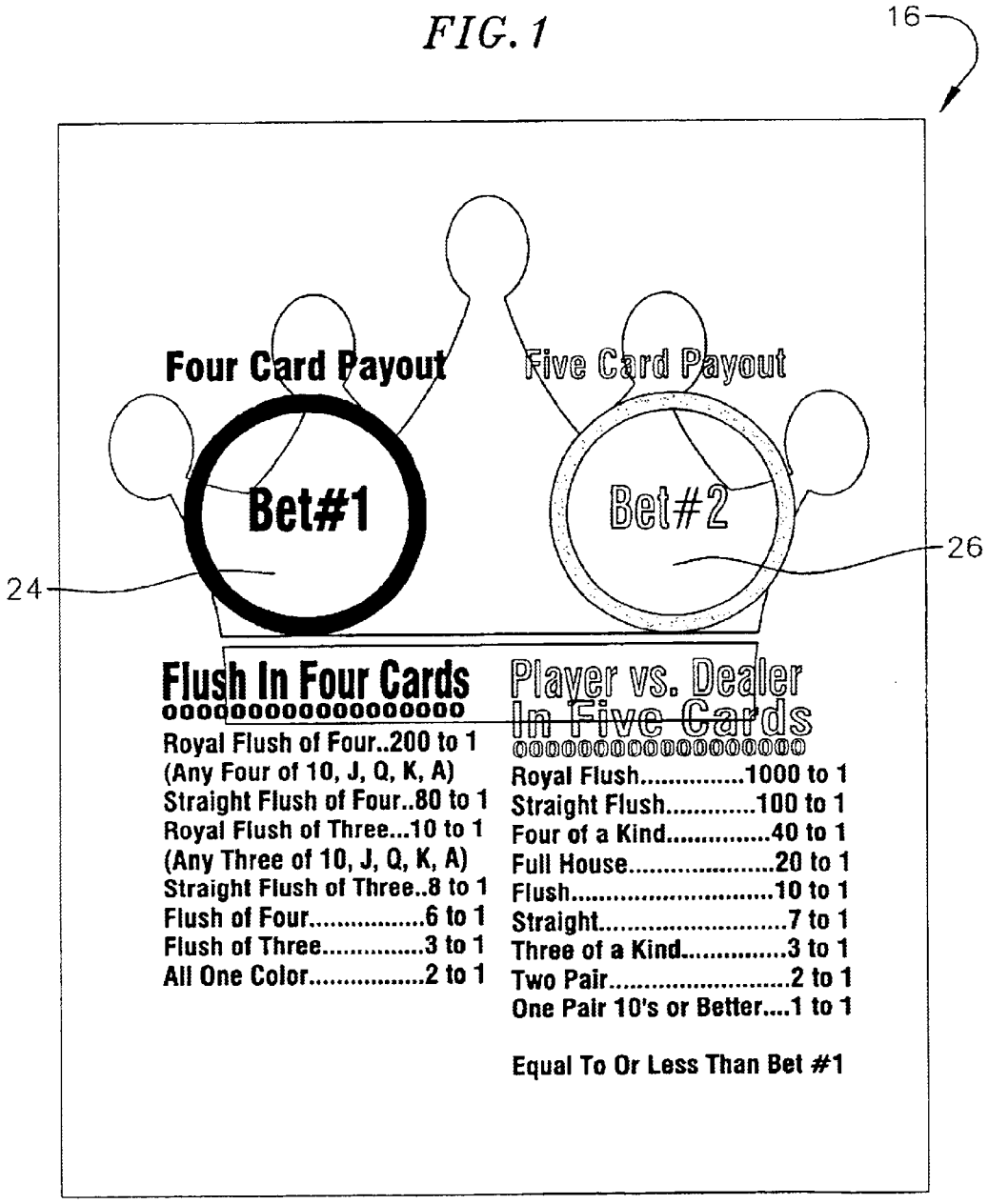
FIG. 1 illustrates an example for a layout for live play of the game.
Figure 2:
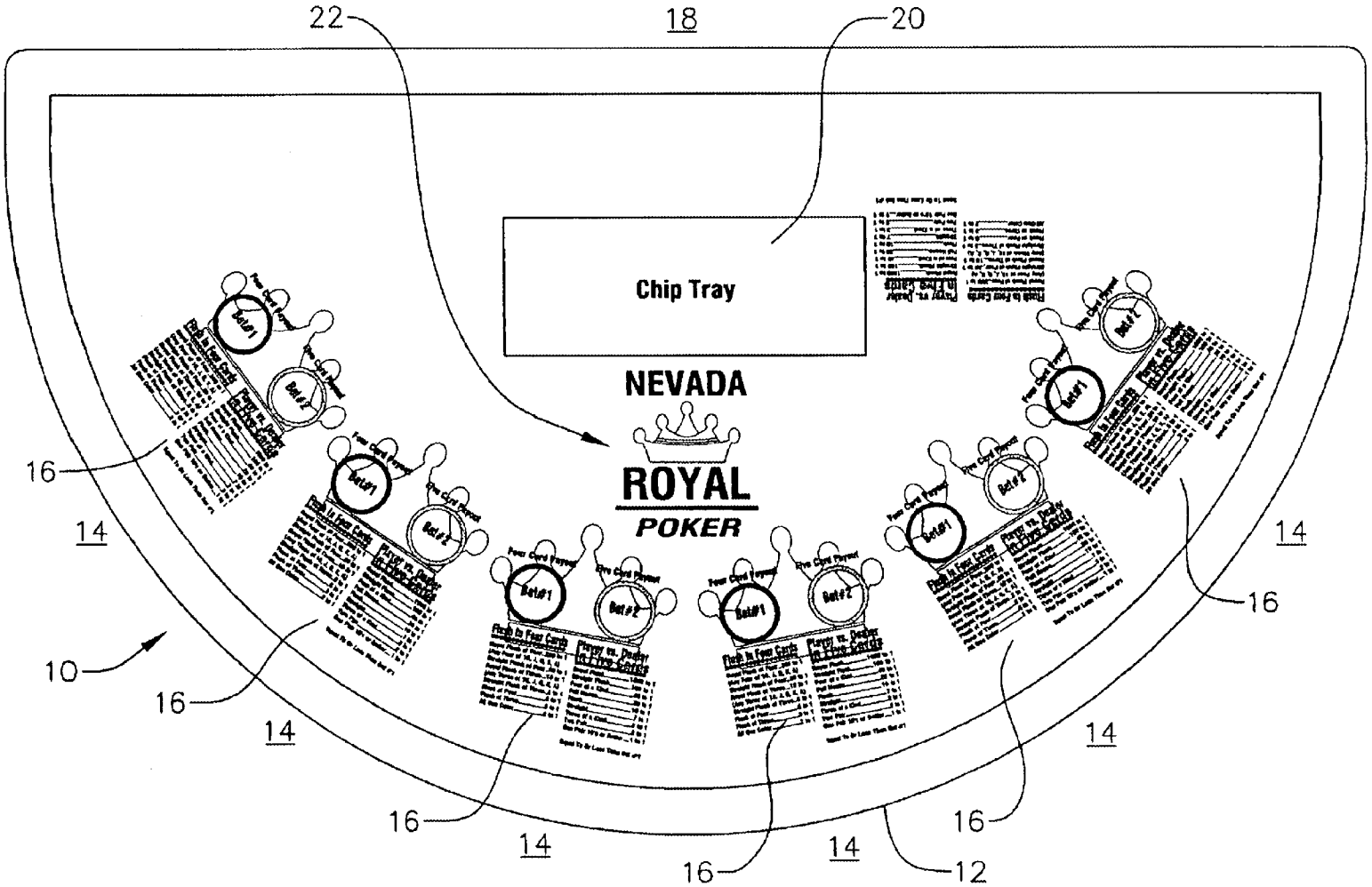
FIG. 2 illustrates the wagering options for the player which may be depicted at each player position on a live play layout.

Turning to FIG. 1 there is shown a layout 10 for live table game play of the game method according to the present invention. The layout 10 may be adapted to be disposed on a Blackjack table and therefore has a shape configured for that purpose. One edge 12 of the layout 10 is arcuate to accommodate six or more player positions 14. Players make and indicate their wagers at each position 14 as is known in the art. Each position 14 is denoted by a wagering area 16 as shown in FIGS. 1 and 2. Opposite that player's positions is a dealers position 18 to be occupied by a live dealer in the live version of the game method of the present invention. Proximate the dealers position 18 is a chip tray 20 to hold the chips received and to be paid out during play of the game. Proximate the center of the layout 10 and between the chip tray 20 and the edge 12 is a dealer hand area 22 to receive and display the cards for the dealer's hand.

With reference to FIGS. 1 and 2 the method of the play of the game will now be described.

To participate in the game, each player makes a first bet by placing a value chip, token or currency in a Bet 1 area 24 indicated in the wagering area 16. The placement of the first wager is mandatory to participate in a hand of play of the game. Upon all players desiring to participate in the hand of play, the dealer deals from a shuffled, standard, fifty-two card deck of playing cards at least three cards to each player. The cards are dealt to the area 16 associated with each participating player.

The first bet is directed to a wager that, after the player is dealt another card, the player will have a four card hand with an outcome corresponding to one of a schedule of outcomes. As shown in FIG. 2, the four card hand, first bet, schedule of winning outcomes and corresponding rewards for each may be according to Table 1 below:

TABLE 1

| | |
|---|---|
| Royal Flush of Four Cards (Any 4 suited 10, J, Q, K Ace) | 200:1 |
| Straight Flush of 4 Cards | 80:1 |
| Royal Flush of Three Cards (Any 3 suited 10, J, Q, K, Ace) | 10:1 |
| Straight Flush of 3 Cards | 8:1 |
| Flush of 4 Cards | 6:1 |
| Flush of 3 Cards | 3:1 |
| All 4 Cards Red or Black | 2:1 |

After receiving the initial three cards the player decides whether or not to place a second bet. The second bet is a wager by the player that, after receiving five cards to make a player five card hand, the player's five card hand will be of (1) a higher ranking than a dealer five card hand and (2) the player's five card hand will have a five card holding that corresponds to a predetermined schedule of winning five card hands as suggested in Table 2 below:

TABLE 2

| | |
|---|---|
| Royal Flush | 1000:1 |
| Straight Flush | 100:1 |
| Four of a kind | 40:1 |
| Full House | 20:1 |
| Flush | 10:1 |
| Straight | 7:1 |
| Three of a kind | 3:1 |
| Two Pair | 2:1 |
| Pair of 10s or better | 1:1 |
| Less than Pair of 10s | Loss |

If the player decides to place a second bet the same is placed in the second bet area 26 indicated in the wagering area 16. For purposes of illustration of the play of the game, it shall be assumed that the player has made a five unit first bet and has been dealt the following first three cards:

3♡5♡7◇.

Further it shall be assumed that the player has made a second bet of five units. It should be noted that it is preferred that the second bet be equal to or less than the second bet. Upon opting to make the second wager, the dealer deals to the player a fourth card defining a player four card holding of:

3♡5♡7◇4♡.

The player's four card hand is then compared by the dealer to the first bet pay schedule as suggested in Table 1 above. The player has (1) a Straight Flush of 3 cards (3♡4♡5♡) and (2) all four cards are of the same color (red). According to the method of the present invention, only the highest pay outcome is rewarded and accordingly the player is paid 40 units for their 5 unit first bet. If the player does not have a four card outcome of the predetermined schedule of Table 1, the player loses their first bet and the same is collected by the dealer.

After the first bet is resolved, attention is turned to the second bet. A fifth card is dealt to each player who made the second wager to define, for each, a five card player hand. Five cards are also dealt from the deck of cards in front of the chip tray 20 to define a five card dealer hand. The dealer's hand may be dealt in stages, e.g. three cards face down when the first three cards are dealt to the player, or in any other sequence. The dealer's five card hand and all second bet player(s) five card hands are exposed for resolution of the second bet. The following rules are used to resolve the second bet wagers:

1. The player's five card hand must be of a predetermined qualifying value according to the ranking of hands of Poker as set forth in the schedule of Table 2 above. If the player's five card hand does not have a qualifying holding of one of the Table 2 outcomes, the second bet is lost and collected by the dealer. Conversely, if the player does have a qualifying holding, the player's five card hand must also,
2. Outrank the dealer's five card hand. Even if the player qualifies, if his five card hand does not outrank the five card dealer hand, the player loses their second bet and the wager is collected by the dealer.

Thus, for the player to win their second bet they must satisfy two conditions: (1) have one of the schedule of qualifying holdings and (2) have a hand which outranks the dealer's hand according to Poker ranking of hands.

For purposes of illustration it shall be assumed that the player has been dealt a fourth card of a 6♧ resulting in a five card players hand of a Straight (3♡4♡5♡6♧7◇). Assuming that the player's hand outranks the dealer's, the player, according to Table 2 and the player's 5 unit second bet, would be paid 7×5=35 units.

After the comparison and resolution of each player's hand, the cards on the layout are collected and the players make a new first wager to participate in the next hand.

The game method according to the present invention may also be played by one or several players using a computer and video display where the processor randomly selects from a data structure to simulate the dealing of cards in the manner described above and where the player wagers game credits. For example, for a video-Poker style game, the player would make the first bet and be dealt a four card stud hand. The four card hand would be compared to the Table 1 schedule and the player's first bet would be won or lost depending upon whether or not the player's four card hand included one of the scheduled holdings. The player, if they so chose, would also make the second bet and be dealt a fifth card. The player's five card hand would be compared to the schedule of Table 2 and if the five card hand comprised one of the scheduled holdings, the player would be issued an award. Thus the game is played with a four card stud hand to determine the first bet and a sequential five card hand to determine the second bet.

The game method can also be practiced one or more players through an Internet connection in a live or virtual format.

Still further, the schedules set forth in Tables 1 and 2 may be modified by adding or deleting predetermined winning outcomes, changing the amounts of the pays or awards or the like. Also, by making corresponding changes to the awards schedules and deck of cards, the game could also be played in a Deuces Wild, Joker's Wild, Deuces an Jokers Wild or other known game format.

The game method of the present invention has the advantages of providing a game where both a four card and five card Player hand award is available, where there is no requirement that the dealer have a qualifying hand, where the second bet need not be a multiple of the first, where more pay outs are provided than in Three Card Poker and where the second wager of the present invention is optional.

While I have shown and described certain embodiments of the present invention it is to be understood that the same are subject to modifications and changes without departing from the scope of the appended claims.

I claim:

1. A method for playing a casino card game between a dealer and a player using a deck of playing cards comprising:

the player making a first bet;

dealing three cards to the player and at least three cards to the dealer;

the player opting to make a second bet;

without regard to whether the player made said second bet, dealing a fourth card to the player and resolving the first bet by comparing the player's four card hand to a first schedule of winning outcomes, the player losing his first wager if the player's four card hand is a losing outcome according to said first schedule and winning his first wager if the player's four card hand is a winning outcome according to said first schedule; and without regard to whether the player won or lost said first bet, if the player made a second bet, completing the player's hand by dealing a fifth card to the player and forming a five card dealer's hand by dealing additional cards to the dealer, if needed, and resolving the second bet by comparing the player's five card hand to the dealer's five card hand, the player losing his second bet if the player's five card hand has a lower ranking than the dealer's five card hand and winning his second wager if the player's five card hand has a higher ranking than the dealer's five card hand.

2. The method of claim 1 comprising defining said first schedule as including one or more of, Royal Flush Any of 10, J, Q, Ace Four card Straight Flush Royal Flush of any Three of 10, J, Q, K, Ace Three card Straight Flush Four Card Flush Three Card Flush Four Cards of the same color (Red or Black).

3. The method of claim 1 comprising defining the first schedule as including corresponding pays of,

| Holding | Pay |
|---|---|
| Royal Flush of Any Four of 10, J, Q, K, Ace | 200:1 |
| Four card Straight Flush | 80:1 |
| Royal Flush of any Three of 10, J, Q, K, Ace | 10:1 |
| Three card Straight Flush | 8:1 |
| Four Card Flush | 6:1 |
| Three Card Flush | 3:1 |
| Four Cards of the same color (Red or Black) | 2:1. |

4. The method of claim 1 comprising defining the second schedule as including at least one of the following holdings:

Royal Flush

Straight Flush

Four of a Kind

Full House

Flush

Straight

Three of a Kind

Two Pair

Pair of 10's or Better.

5. The method of claim 1 comprising defining the second schedule as including corresponding pays of,

| Five Card Holding | Pay |
|---|---|
| Royal Flush | 1000:1 |
| Straight Flush | 100:1 |
| Four of a Kind | 40:1 |
| Full House | 20:1 |
| Flush | 10:1 |
| Straight | 7:1 |
| Three of a Kind | 3:1 |
| Two Pair | 2:1 |
| Pair of 10's or Better | 1:1. |

6. A method for playing a casino card game between a dealer and a player using representations of playing cards comprising:

a player making a first bet;

presenting a first hand of less than five cards to the player, the player examining the said cards and opting to make a second bet;

without regard to whether the player made said second bet, comparing the player first hand to a first pay schedule defining first bet winning outcomes and if the player has a first bet winning outcome paying the player according to the first pay schedule of outcomes, otherwise the player losing said first bet; and without regard to whether the player won or lost said first bet, if the player made the second bet, completing the player hand to a five card player hand by dealing additional cards until the player has five cards and dealing five cards to a dealer hand and comparing the five card dealer hand to the five card player hand and if the player's five card hand both (i) has one of a schedule of predetermined holdings according to the ranking of hands of Poker and (ii) outranks the five card dealer's hand according to the ranking of hands of Poker regardless of the holding of the five card dealer's hand, issuing an award to the player based on said second bet, otherwise the player losing said second bet.

7. The method of claim 6 comprising defining the first pay schedule as,

| Holding | Pay |
|---|---|
| Royal Flush of Any Four of 10, J, Q, K, Ace of a suit | 200:1 |
| Four card Straight Flush | 80:1 |
| Royal Flush of any Three of 10, J, Q, K, Ace of a suit | 10:1 |
| Three card Straight Flush | 8:1 |
| Four Card Flush | 6:1 |
| Three Card Flush | 3:1 |
| Four Cards of the same color (Red or Black) | 2:1. |

8. The method of claim 6 comprising defining the second pay schedule as,

| Five Card Holding | Pay |
|---|---|
| Royal Flush | 1000:1 |
| Straight Flush | 100:1 |
| Four of a Kind | 40:1 |
| Full House | 20:1 |
| Flush | 10:1 |
| Straight | 7:1 |
| Three of a Kind | 3:1 |
| Two Pair | 2:1 |
| Pair of 10's or Better | 1:1 |
| Less than a Pair of 10's | Loss of Second Bet. |

9. A method for conducting a wagering game using playing cards between a player and a dealer, comprising:

said player making a first bet;

dealing an incomplete hand to said player;

said player opting to make an optional second bet;

without regard to whether said player made said second bet, resolving said first bet by dealing at least one additional card to said player to form a first hand and comparing said first hand to a first schedule of hands, said player losing said first bet if said first hand is a losing outcome according to said first pay schedule of outcomes, said player winning said first bet and receiving an award if said first hand is a winning outcome according to said first pay schedule of outcomes; and without regard to whether said player won or lost said first bet, if said player made said second bet, resolving said second bet by dealing at least one additional card to said player to form a second hand, dealing cards to said dealer to form a dealer hand, and comparing said player second hand to said dealer hand, said player losing said second bet if said dealer hand outranks said player second hand, said player winning said second bet and receiving a second award if said second hand outranks said dealer hand and said second hand is a winning hand according to a schedule of schedule of holdings.

* * * * *